US008371551B2

(12) United States Patent
Jang

(10) Patent No.: US 8,371,551 B2
(45) Date of Patent: Feb. 12, 2013

(54) APPARATUS FOR ADJUSTING LEVEL OF REFRIGERATOR

(75) Inventor: Woo-Jin Jang, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 290 days.

(21) Appl. No.: 12/865,834

(22) PCT Filed: Dec. 30, 2008

(86) PCT No.: PCT/KR2008/007773

§ 371 (c)(1),
(2), (4) Date: Aug. 2, 2010

(87) PCT Pub. No.: WO2009/110675

PCT Pub. Date: Sep. 11, 2009

(65) Prior Publication Data

US 2011/0001414 A1 Jan. 6, 2011

(30) Foreign Application Priority Data

Mar. 7, 2008 (KR) ..... 10-2008-0021644

(51) Int. Cl.
*F25D 23/00* (2006.01)
*F16M 13/00* (2006.01)

(52) U.S. Cl. ..... 248/542; 248/550; 312/405; 340/681

(58) Field of Classification Search ..... 248/542, 248/550, 694; 340/687; 312/405
See application file for complete search history.

(56) References Cited

U.S. PATENT DOCUMENTS

| | | | | |
|---|---|---|---|---|
| 2,979,857 | A * | 4/1961 | Longbotham | 248/542 |
| 4,459,813 | A * | 7/1984 | Petta | 62/132 |
| 4,669,696 | A * | 6/1987 | Petta | 248/550 |
| 4,860,553 | A * | 8/1989 | Evans | 62/297 |
| 5,732,913 | A | 3/1998 | Shin | |
| 6,910,665 | B2 * | 6/2005 | Avendano et al. | 248/188.2 |

FOREIGN PATENT DOCUMENTS

| | | | |
|---|---|---|---|
| KR | 10-0145536 | B1 | 5/1998 |
| KR | 10-0198007 | B1 | 6/1999 |
| KR | 2001-0010599 | A | 2/2001 |

* cited by examiner

*Primary Examiner* — Anita M King
(74) *Attorney, Agent, or Firm* — Birch, Stewart, Kolasch & Birch, LLP

(57) ABSTRACT

An apparatus for adjusting the level of a refrigerator includes: a main body; a guide groove formed to be level in a forward/backward direction of the main body; a movement unit inserted in the guide groove and moving in the direction in which the main body is inclined; a contact point part formed at one of both ends of the guide groove and selectively connected to the movement unit; and a notifying unit informing about whether or not the contact point part is connected. When the refrigerator is installed, an installation technician can recognize whether or not the refrigerator is installed to be level regardless of a skilled degree of the installation technician, so the installation time can be shortened and a service satisfaction of consumers can be increased.

17 Claims, 5 Drawing Sheets

APPARATUS FOR ADJUSTING LEVEL OF REFRIGERATOR

TECHNICAL FIELD

The present invention relates to a refrigerator and, more particularly, to an apparatus for adjusting the level of a refrigerator capable of checking whether or not a refrigerator is level with the floor.

BACKGROUND ART

In general, a refrigerator is a device for keeping food items at storage at a low temperature, in which food items are frozen or refrigerated according to their states.

Cold air supplied to the interior of the refrigerator is generated according to a heat exchange operation of a refrigerant, and continuously supplied into the interior refrigerator while repeatedly performing a cycle of compression-condensation-expansion-evaporation, and the supplied cold air is evenly transmitted into the interior of the refrigerator by convection current to keep food items at storage at a desired temperature within the refrigerator.

The refrigerator includes storage chambers such as a freezing chamber, refrigerating chamber, or the like, to store the food items, and a door for opening and closing the storage chambers. In order to facilitate opening and closing the door, the refrigerator is required to be installed such that it is slightly inclined backward.

For this purpose, generally, the refrigerator is installed by installation technicians of its manufacturer.

However, the related art refrigerator has the following problems.

That is, first, in installing the refrigerator by the installation technicians, the refrigerator is installed only relying on the sensation of the installation technicians. In this case, although the installation technicians are skilled, they may need a trial and error several times, causing a service dissatisfaction of consumers.

Second, the installation of the refrigerator relying on the sensation of the installation technicians may cause a front-inclined installation of the refrigerator, resulting in that the door of the refrigerator may not be closed to cause a service dissatisfaction of consumers.

DISCLOSURE OF INVENTION

Technical Problem

Therefore, in order to address the above matters, the various features described herein have been conceived. One aspect of the exemplary embodiments is to provide an apparatus for adjusting the level of a refrigerator capable of allowing an installation technician to recognize whether or not a refrigerator is being properly installed.

Technical Solution

This specification provides an apparatus for adjusting the level of a refrigerator, including: a main body; a guide groove formed to be level in a forward/backward direction of the main body; a movement unit inserted in the guide groove and moving in the direction in which the main body is inclined; a contact point part formed at one of both ends of the guide groove and selectively connected by the movement unit; and a notifying unit informing about whether or not the contact point part is connected.

The main body may include a storage chamber, a door for closing the storage chamber, and a door switch for informing about whether or not the door is open, and the guide groove is formed at an inner side of the door switch.

The door switch may be installed horizontally in a forward/backward direction of the main body.

The contact point part may be installed at an end portion close to the front surface of the main body, among both ends of the guide groove.

The notifying unit may be formed as a speaker operated by the contact point part to make an alarm sound when the contact point part is connected.

The contact point part may include a first terminal fixed to one end portion of the guide groove and a second terminal pressed by the movement unit to come in contact with the first terminal.

Advantageous Effects

The apparatus for adjusting the level of the refrigerator according to the embodiments of the present invention has the following advantages.

An installation technician can recognize whether or not the refrigerator is installed to be level regardless of a skilled degree of the installation technician, so the installation time can be shortened and a service satisfaction of consumers can be increased.

Also, because there is no possibility that the refrigerator is erroneously installed, a problem that the door of the refrigerator is not closed can be prevented.

Furthermore, because the level adjusting apparatus is integrally formed with an illumination switch that selectively illuminates the storage chamber according to whether or not the door is open or closed, an increase in number of times of assembling can be prevented.

BEST MODE FOR CARRYING OUT THE INVENTION

An apparatus for adjusting the level of a refrigerator according to a first embodiment of the present invention will now be described in detail with reference to the accompanying drawings.

First, the refrigerator employing the level adjusting apparatus according to the first embodiment of the present invention will now be described with reference to FIG. 1.

Figure 1:
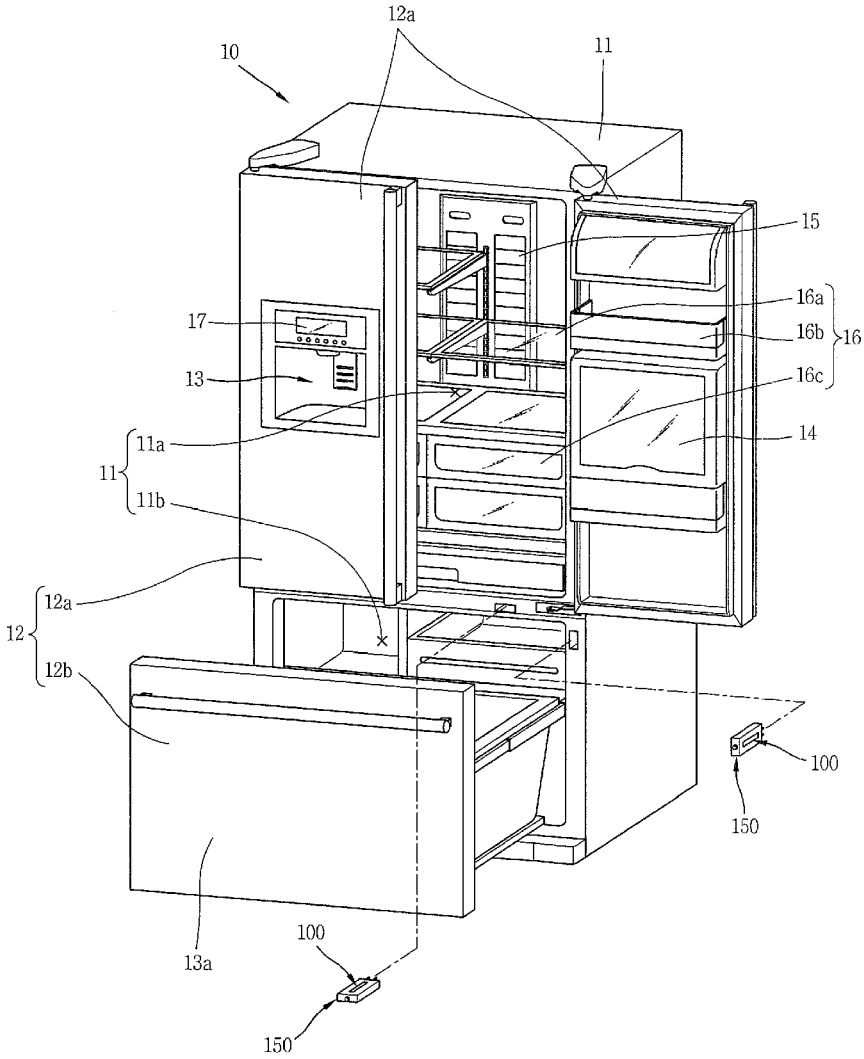
FIG. 1 is a view showing a refrigerator employing an apparatus for adjusting the level of a refrigerator according to a first embodiment of the present invention.

FIG. 1 is a view showing a refrigerator employing the level adjusting apparatus for a refrigerator according to a first embodiment of the present invention.

With reference to FIG. 1, a refrigerator 10 according to a first embodiment of the present invention includes main body comprised of a storage chamber 11 and a door 12 for opening and closing the storage chamber 11, and a refrigerating cycle (not shown) for generating cold air supplied to the storage chamber 11.

Here, the main body forms an external appearance of the refrigerator 10 with a substantially cubic shape, and the main body includes the storage chamber 11 and the door 12 for opening and closing the storage chamber 11.

The storage chamber 11 includes a refrigerating chamber 11*a* for keeping food items in storage at a low temperature of about 1 C below zero to 3 C above zero and a freezing chamber 11*b* for freezing food items at 20 C to 16 C below zero to keep them in storage.

The refrigerating chamber 11*a* and the freezing chamber 11*b* are formed with one side thereof opened to allow the storage items to be taken in or out, and the opened side is closed by the door 12. The door 12 includes a refrigerating chamber door 12*a* and a freezing chamber door 12*b*.

The positions of the refrigerating chamber 11*a* and the freezing chamber 11*b* and the form of the door 12 may vary according to types of refrigerators.

FIG. 1 shows an example that the refrigerating chamber 11*a* is provided at an upper portion, the freezing chamber 11*b* is provided at a lower portion, the refrigerating chamber door 12*a* is provided to be rotated in both directions at the front side of the refrigerating chamber 11*a*, and the freezing chamber door 12*b* is drawn out to the front side of the main body.

Meanwhile, the refrigerator 10 may include receiving units 16 in various forms to receive storage items.

The receiving units 16 are provided in the refrigerating chamber 11*a*, the freezing chamber 11*b*, the refrigerating chamber door 12*a*, and the freezing chamber door 12*b*.

The receiving units 16 may be a shelf 16*a* horizontally installed to allow storage items to be put thereon and received therein, a drawer 16*c* installed to allow the storage items received therein to be taken in or out, a door basket 16*b* installed on the rear surface of the refrigerating chamber door 12*a* to receive food items or the like, and a basket coupled with the freezing chamber door 12*b* and taken in or out together with the freezing chamber door 12*b*, or the like.

The refrigerator 10 may include a dispenser 13, a home bar 14, or the like, for the user convenience.

The dispenser 13 is generally provided on the front side of the door 12 to allow the user to take ice or water stored in the storage chamber 11 without having to open the door 12.

The home bar 14 is generally provided at the front side of the door 12 like the dispenser 13, and allowing frequently taken storage items to be taken out without opening the door 12.

A lighting device 15 may be further provided within the storage chamber 11 to illuminate the interior of the storage chamber 12 to facilitate checking of storage items.

The lighting device 15 is operated according to whether or not the door 12 is open, for which a door switch 150 is provided to detect whether or not the door 12 is open.

A level adjusting device 100 is provided within the door switch 150 in order to detect an inclined state of the main body, in particular, a state that the main body is inclined in a forward/backward direction, and inform accordingly.

The door switch 150 and the level adjusting device 100 will now be described in detail with reference to FIGS. 2 to 5.

Figure 2:
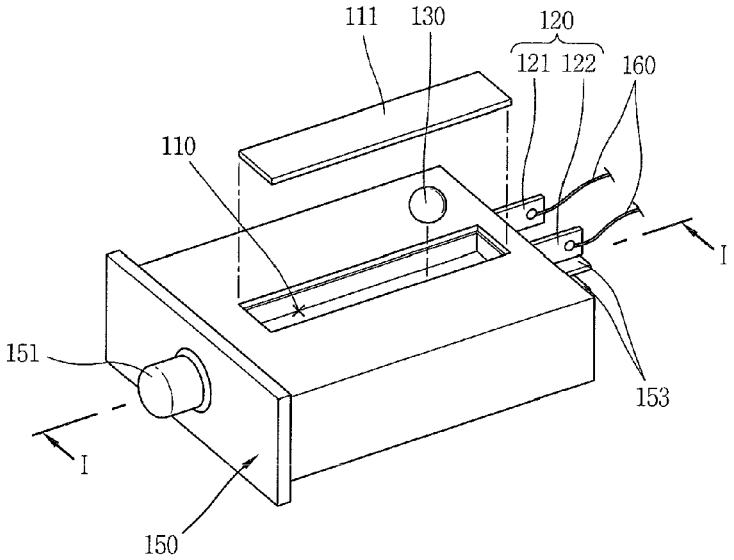
FIG. 2 is a view showing a door switch with the level adjusting apparatus according to an embodiment of the present invention.
Figure 3:
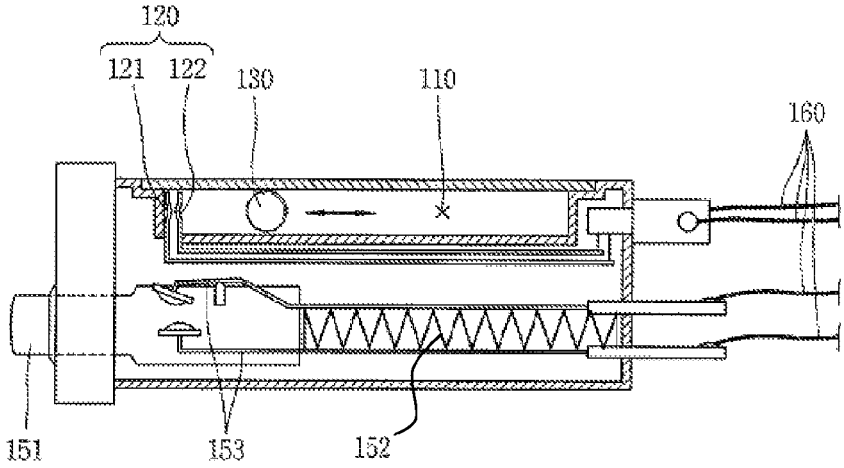
FIGS. 3 and 4 are sectional views taken along line I-I in FIG. 2 showing an operation of the door switch.
Figure 4:
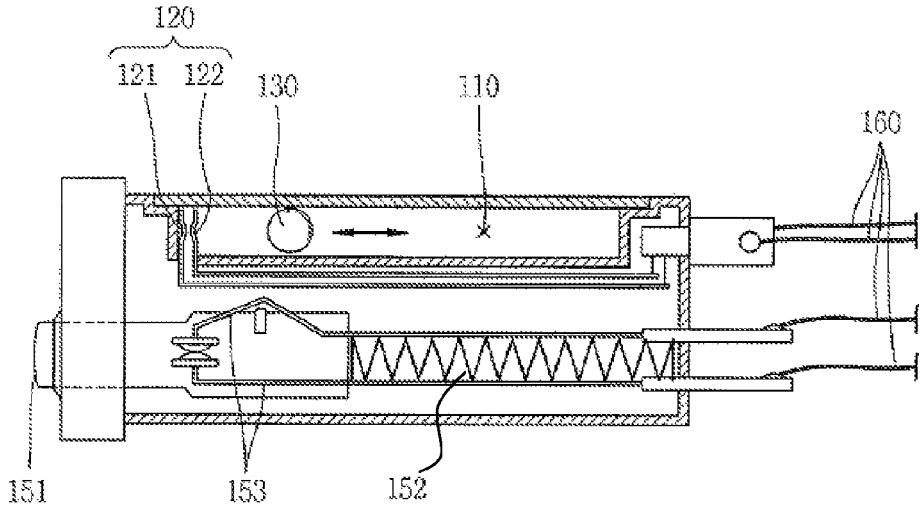
Figure 5:
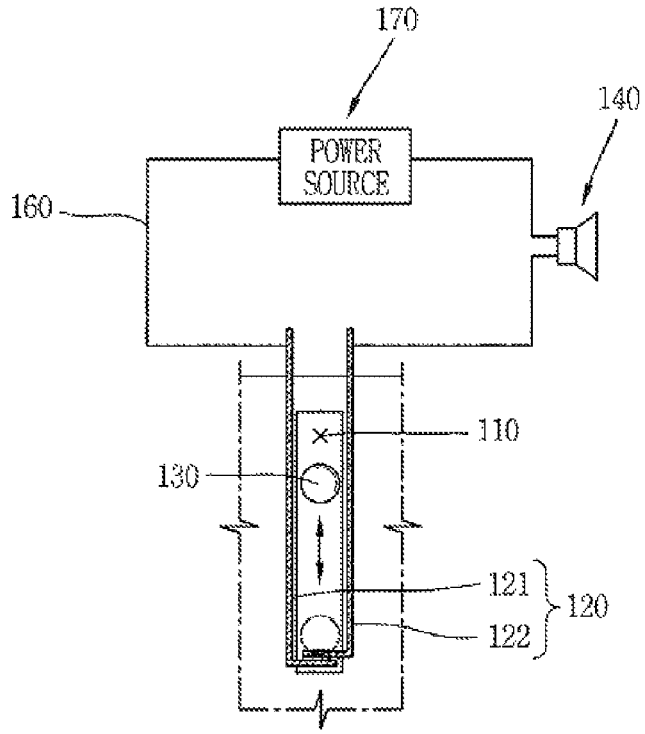
FIG. 5 is a view showing the configuration of the level adjusting apparatus according to an embodiment of the present invention.

FIG. 2 is a view showing a door switch with the level adjusting apparatus according to an embodiment of the present invention, FIGS. 3 and 4 are sectional views taken along line I-I in FIG. 2 showing an operation of the door switch, and FIG. 5 is a view showing the configuration of the level adjusting apparatus according to an embodiment of the present invention.

First, the configuration and operation of the door switch 150 will now be described in detail with reference to FIGS. 2 to 4.

As shown in FIGS. 2 to 4, the door switch 150 is installed at one side of the storage chamber 11 such that it is pressed by the door 12 when the storage chamber 11 is closed by the door 12.

Here, the door switch 150 may be installed to correspond to a rear surface of the door 12 so that it can be easily pressed when the door 12 is closed.

Thus, the door switch 150 is preferably installed to be level in the forward/backward direction.

The door switch 150 includes a pressed portion 151 selectively pressed by the door 12, an elastic member 152 providing a restoration force in the direction that the pressed portion 151 is pressed, and a connection terminal 153 selectively connected by the pressed portion 151.

The connection terminal 153 is connected with the lighting device 15, and the lighting device 15 is turned on or off according to a connection state with the connection terminal.

Namely, with the door 12 closed, the pressed portion 151 is pressed by the door 12, so the contacting with the connection terminal 151 is released and the lighting device 15 is maintained in an OFF state.

When the door 12 is opened by a user, the pressed state of the pressed portion 151 is released by the elastic member 152, so the connection terminal 153 is connected and the lighting device 15 is turned on. Accordingly, storages taken into or out of the storage chamber 11 can be easily checked.

The level adjusting device 100 according to an embodiment of the present invention is formed at one side of the door switch 150.

The level adjusting device 100 will now be described in detail with reference to FIG. 5.

With reference to FIG. 5, the level adjusting device 100 according to an embodiment of the present invention includes a guide groove 110 having a contact point part 120 formed at one end thereof, a movement unit 130 positioned to be movable along the interior of the guide groove 110, and a notifying unit 140 informing about whether or not the contact point part 120 is connected such that it can be recognized from outside the main body.

The guide groove 110 is formed at the door switch 150, and the door switch 150 is installed at the main body such that the guide groove 110 is positioned to be level in the forward/backward direction of the main body.

Thus, preferably, the guide groove 110 is formed in a lengthwise direction of the door switch 150, and the door switch 150 is fixed to the main body such that its lengthwise direction is consistent with the forward/backward direction of the main body and level.

Namely, preferably, the horizontal installation of the guide groove 110 is guaranteed by installing the door switch 150 such that it is level, rather than working while checking whether or not the guide groove 110 is level.

The guide groove 110 is hermetically closed by a shielding member 111 in order to prevent the movement unit 130 from being released and moisture from being introduced into the guide groove 110.

The contact point part 120 is formed on at one of both ends of the guide groove 110, and includes a first terminal 121 fixed to one end portion of the guide groove 110 and a second terminal 122 pressed by the movement unit 130 so as to contact with the first terminal.

The first and second terminals 121 and 122 are connected with the notifying unit 140 and a power source unit 170 by a power line 160 and transfer whether or not the contact point part 120 is connected via the notifying unit 140.

Here, the second terminal 122 may be made of a material with elasticity so as to be elastically pressed by the movement unit 130.

Preferably, the refrigerator 10 is generally installed to be slightly inclined toward the rear side to allow the door 12 to be easily open and closed.

Thus, preferably, the contact point part 120 for detecting whether or not the refrigerator 10 is properly installed is installed at an end portion near the front side of the main body among both ends of the guide groove.

The contact point part 120 may be formed at the end portion near the rear side of the main body among both ends of the guide groove, and in this case, the contact point part 120 also has the function of detecting whether or not the refrigerator 10 is properly installed and informing accordingly.

The movement unit 130 is inserted into the guide groove and moves in the direction in which the main body is inclined.

In general, the movement unit 130 may have a spherical shape having good rolling properties, but without being limited thereto, any shape may be available so long as the movement unit is movable.

The movement unit 130 may be made of a material with a certain mass to apply a pressing force to the second terminal 122.

Here, the movement unit 130 may be made of a material with high density to have a certain mass because its volume is limited by the width of the guide groove 110.

The mass and density of the movement unit 130 may be determined according to the width of the guide groove 110 and the elasticity strength of the second terminal 122.

The notifying unit 140 is to inform about whether or not the contact point part 120 is connected, and is connected with the contact point part 120 and the power source unit 170 by the power line 160.

The notifying unit 140 is provided as a speaker or the like to allow the installation technician to audibly check an installation state when the refrigerator 10 is installed.

Here, the speaker may not be separately provided, and a speaker provided to make an alarm sound when the refrigerator 10 is abnormally operated may be used.

Hereinafter, the refrigerator according to a second embodiment of the present invention will now be described with reference to the accompanying drawings. In the following description, any contents and explanations that have already been made for the first embodiment will be omitted for the sake of brevity.

Figure 6:
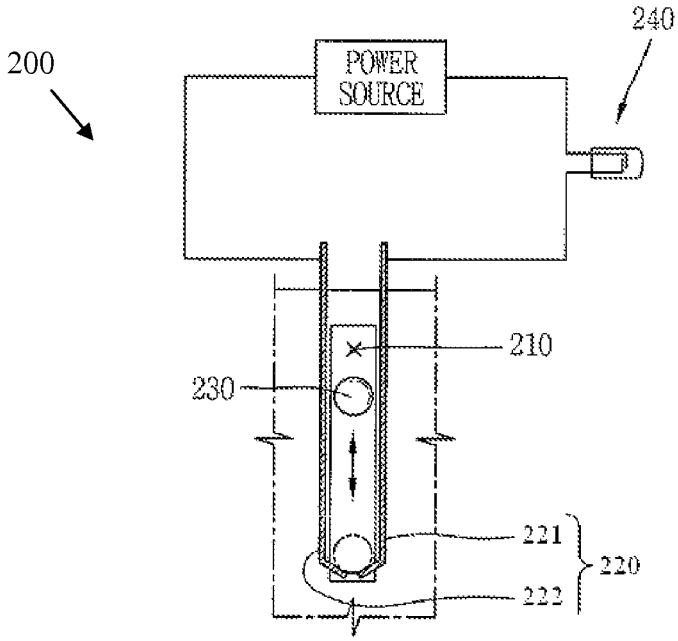
FIG. 6 is a view showing the configuration of a level adjusting apparatus according to a second embodiment of the present invention.

FIG. 6 is a view showing the configuration of a level adjusting apparatus according to a second embodiment of the present invention.

As shown in FIG. 6, a level adjusting device 200 includes a guide groove 210 having a contact point part 220 formed at one end thereof, a movement unit 230 positioned to be movable along the interior of the guide groove 210, and a notifying unit 240 informing about whether or not the contact point part 220 is connected such that it can be recognized from outside the main body.

Here, the contact point 220 includes first and second terminals 221 and 222 spaced apart by a certain distance so as to be connected by contacting with the movement unit 230, respectively.

The movement unit 230 is made of a material with electroconductivity and electrically connects the first and second terminals 221 and 222 which are in contact with the movement unit 230.

In this embodiment, the notifying unit 240 visually informs about whether or not the contact point part 220 is connected through one external portion of the main body.

Here, the notifying unit 240 may be provided as an element such as a light emitting diode (LED).

The notifying unit 240 may be replaced by a display 17 (See FIG. 1) provided on the front side of the door 12 to display an operational state of the refrigerator 10 or receive an operational command of the refrigerator 10 from outside.

A refrigerator according to a third embodiment of the present invention will now be described in detail with reference to the accompanying drawings. In the following description, any contents and explanations that have already been made for the first embodiment will be omitted for the sake of brevity.

Figure 7:
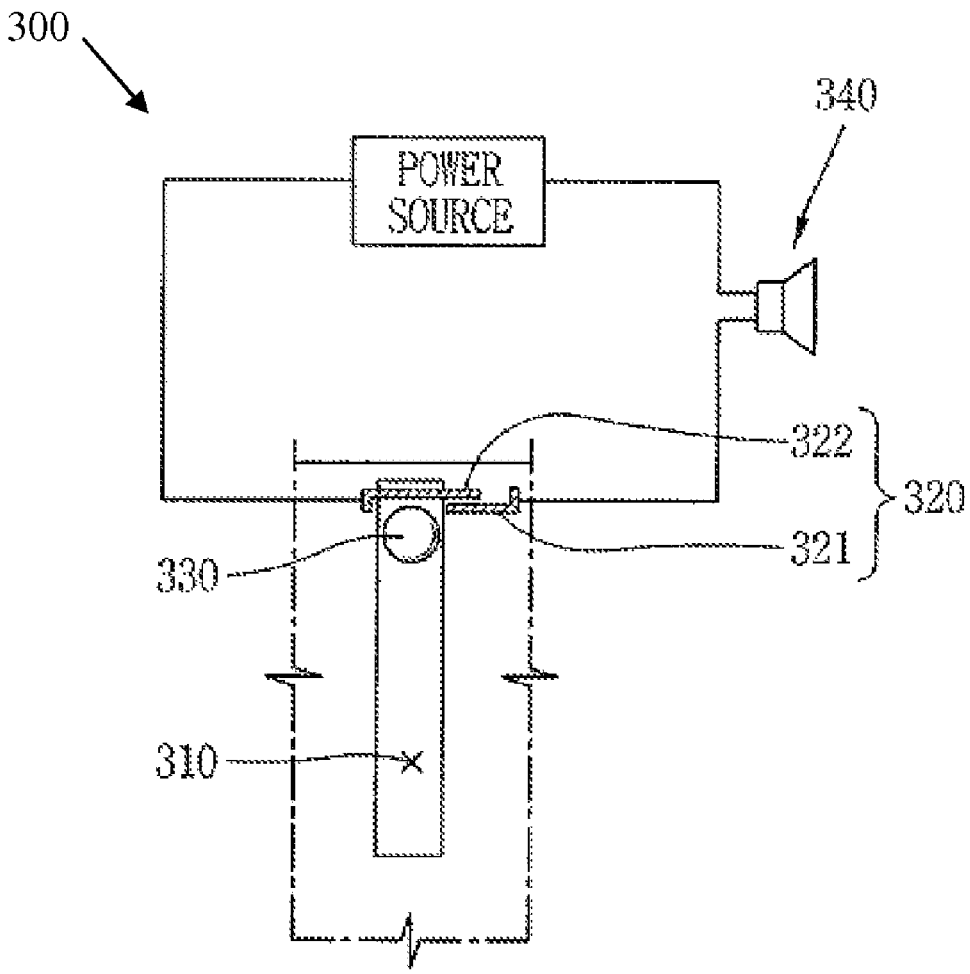
FIG. 7 is a view showing the configuration of a level adjusting apparatus according to a third embodiment of the present invention.

FIG. 7 is a view showing the configuration of a level adjusting apparatus according to a third embodiment of the present invention.

As shown in FIG. 7, a level adjusting device 300 according to the third embodiment of the present invention includes: a guide groove 310 having a contact point part 320, a movement unit 330 positioned to be movable along the interior of the guide groove 310, and a notifying unit 340 informing about whether or not the contact point part 320 is connected such that it can be recognized from outside the main body.

In the third embodiment of the present invention, the contact point part 320 includes first and second terminals 321 and 322. But the first and second terminals 321 and 322 are different from those of the previous embodiment in that a contacted state of the first and second terminals 321 and 322 is cut off by the movement unit 320.

Namely, when the refrigerator 10 is normally installed, the first and second terminals 321 and 322 are disconnected and the operation of the notifying unit 340 is stopped.

The configuration will be described in detail as follows.

In this embodiment, the first terminal 321 is provided to be fixed to an outer side of the guide groove 310. The second terminal 322 is provided at one end of the guide groove 310 while being in contact with the first terminal 321, and deformed by the movement unit 330 so as to be selectively separated from the first terminal 321.

Thus, in this embodiment, the movement unit 330 is provided to be in contact only with the second terminal 322.

In the third embodiment of the present invention, the size of the first and second terminals 321 and 322 can be small, so a smaller amount of the material can be used.

Hereinafter, a refrigerator according to a fourth embodiment of the present invention will now be described with reference to the accompanying drawings. In the following description, any contents and explanations that have already been made for the first embodiment will be omitted for the sake of brevity.

Figure 8:
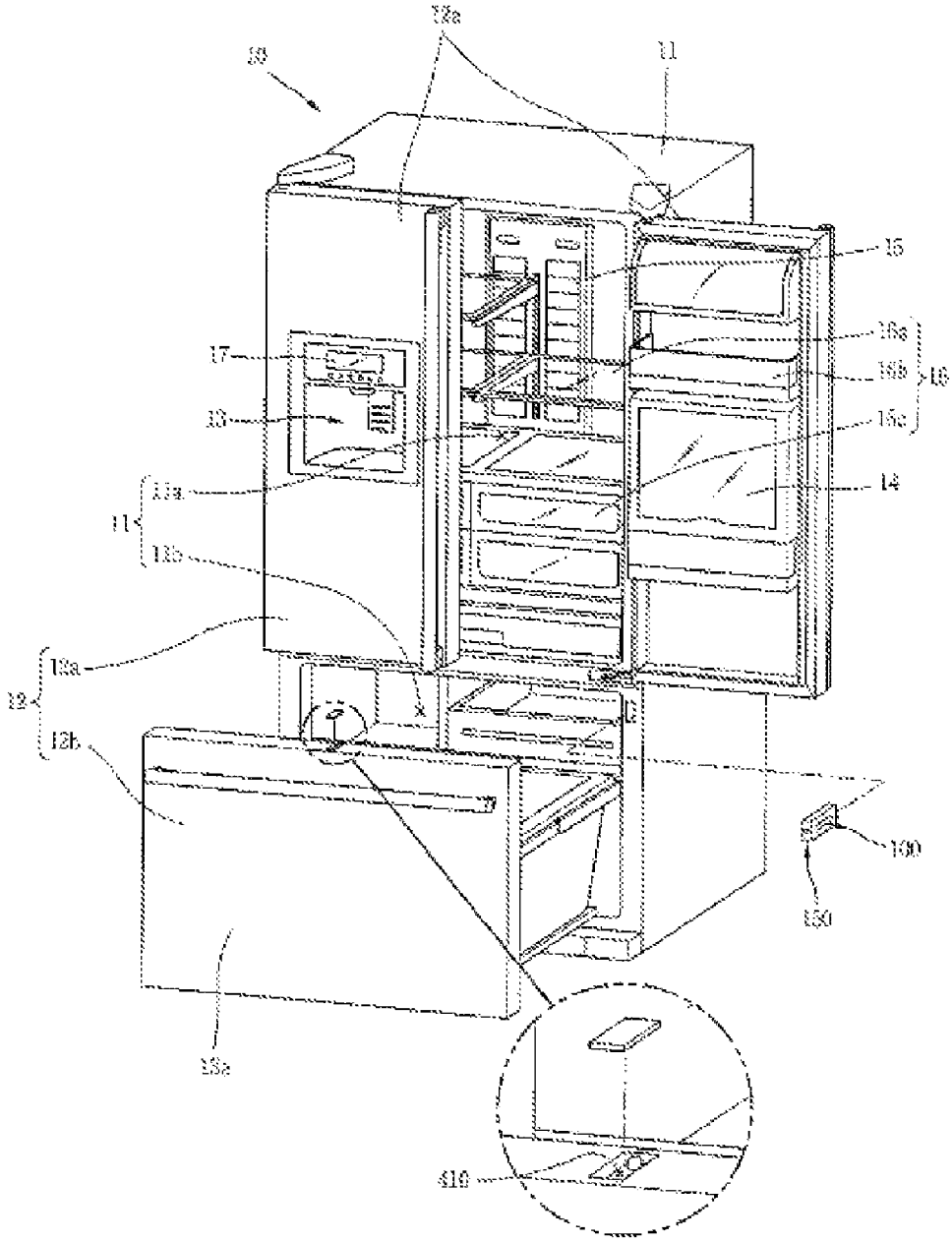
FIG. 8 is a view showing a refrigerator employing a level adjusting apparatus according to a fourth embodiment of the present invention.

FIG. 8 is a view showing a refrigerator employing a level adjusting apparatus according to a fourth embodiment of the present invention.

As shown in FIG. 8, the refrigerator 10 having a level adjusting device according to the fourth embodiment of the present invention includes a door 12*b* slidably moved in the forward/backward direction of the main body 11 so as to be opened, and a guide groove 410 is provided on an upper surface of the door 12*b* in the direction that the door 12*b* is slid.

Accordingly, whether or not the main body 11 is normally installed can be informed, and a state that a front side of the sliding door 12*b* sags downwardly can be also informed, so a damage of the sliding door 12*b* can be prevented.

As the present invention may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

The invention claimed is:

1. An apparatus for adjusting the level of a refrigerator, comprising:

a door switch for informing about whether or not the door is open, wherein the door switch is installed horizontally in a forward/backward direction of a main body, wherein the main body is comprised of a refrigerating chamber and a door for selectively opening and closing the refrigerating chamber;

a guide groove formed to be level in a forward/backward direction of the door switch;

a movement unit inserted in the guide groove and moving in the direction in which the main body is inclined;

a contact point part formed at one of both ends of the guide groove and selectively connected by the movement unit; and a notifying unit informing about whether or not the contact point part is connected.

2. The apparatus of claim 1, wherein the contact point part is installed at an end portion close to the front surface of the main body, among both ends of the guide groove.

3. The apparatus of claim 1, wherein the guide groove is closed by a shielding member to prevent the movement unit from being released.

4. The apparatus of claim 1, wherein the notifying unit is formed as a speaker operated by the contact point part to make an alarm sound when the contact point part is connected.

5. The apparatus of claim 1, wherein the notifying unit visually informs about whether or not the contact point part is connected via the front side of the door.

6. The apparatus of claim 1, wherein the contact point part comprises:

a first terminal fixed to one end portion of the guide groove; and a second terminal pressed by the movement unit to come in contact with the first terminal.

7. The apparatus of claim 1, wherein the movement unit is made of a material with electro-conductivity, and the contact point part comprises first and second terminals spaced apart by a certain distance so as to be connected by contacting with the movement unit.

8. The apparatus of claim 1, wherein the movement unit has a bead shape.

9. The apparatus of claim 1, wherein the contact point part comprises:

a first terminal fixed to an outer side of the guide groove; and a second terminal provided at one end of the guide groove in a state of contacting with the first terminal, and deformed by the movement unit so as to be selectively separated from the first terminal.

10. The apparatus of claim 1, wherein at least one of the doors is slidably moved in a forward/backward direction of the main body so as to be open or closed, and the guide groove is provided on an upper surface of the sliding door in a direction that the door is slid.

11. An apparatus for adjusting the level of a refrigerator, comprising:

a guide groove formed to be level in a forward/backward direction of a main body of the refrigerator, wherein the main body is comprised of a refrigerating chamber and a door for selectively opening and closing the refrigerating chamber;

a movement unit inserted in the guide groove and moving in the direction in which the main body is inclined;

a contact point part formed at one of both ends of the guide groove and selectively connected by the movement unit; and a notifying unit informing about whether or not the contact point part is connected.

12. The apparatus of claim 11, wherein the contact point part is installed at an end portion close to the front surface of the main body, among both ends of the guide groove.

13. The apparatus of claim 11, wherein the guide groove is closed by a shielding member to prevent the movement unit from being released.

14. The apparatus of claim 11, wherein the contact point part comprises:

a first terminal fixed to one end portion of the guide groove; and a second terminal pressed by the movement unit to come in contact with the first terminal.

15. The apparatus of claim 11, wherein the movement unit is made of a material with electro-conductivity, and the contact point part comprises first and second terminals spaced apart by a certain distance so as to be connected by contacting with the movement unit.

16. The apparatus of claim 11, wherein the movement unit has a bead shape.

17. The apparatus of claim 11, wherein the contact point part comprises:

a first terminal fixed to an outer side of the guide groove; and a second terminal provided at one end of the guide groove in a state of contacting with the first terminal, and deformed by the movement unit so as to be selectively separated from the first terminal.

* * * * *